US006283718B1

(12) United States Patent
Prosperetti et al.

(10) Patent No.: US 6,283,718 B1
(45) Date of Patent: Sep. 4, 2001

(54) BUBBLE BASED MICROPUMP

(75) Inventors: Andrea Prosperetti, Baltimore; Hasan N. Oguz, Owings Mill; He Yuan, Clarksville, all of MD (US)

(73) Assignee: John Hopkins University, Baltimore, MA (US)

( * ) Notice: Subject to any disclaimer, the term of this patent is extended or adjusted under 35 U.S.C. 154(b) by 0 days.

(21) Appl. No.: 09/348,480

(22) Filed: Jul. 7, 1999

Related U.S. Application Data

(60) Provisional application No. 60/117,627, filed on Jan. 28, 1999.

(51) Int. Cl.[7] ..... F04B 19/24

(52) U.S. Cl. ..... 417/52; 417/208; 417/207; 347/56

(58) Field of Search ..... 417/208, 48, 52, 417/207; 347/54, 56, 61, 62

(56) References Cited

U.S. PATENT DOCUMENTS

| | | | | |
|---|---|---|---|---|
| 4,251,824 | * | 2/1981 | Hara et al. | 346/410 R |
| 4,625,790 | * | 12/1986 | Okayasu | 417/209 |
| 4,792,283 | * | 12/1988 | Okayasu | 417/52 |
| 4,881,089 | * | 11/1989 | Saito et al. | 347/56 |
| 5,649,423 | * | 7/1997 | Sniegowski | 60/531 |
| 5,663,754 | * | 9/1997 | Lorenze, Jr. et al. | 347/87 |
| 6,062,678 | * | 5/2000 | Ishinaga et al. | 347/62 |

FOREIGN PATENT DOCUMENTS

| | | | | |
|---|---|---|---|---|
| 568024-A2 | * | 11/1993 | (EP) | 417/207 |
| 1-188347 | * | 7/1989 | (JP) | 347/62 |

OTHER PUBLICATIONS

X. M. Chen and A. Prosperetti, Thermal Processes in the Oscillations of Gas Bubbles in Tubes, J. Acoust. Soc. Am., 1998 Acoustical Society of America, vol. 104, No. 3, Pt. 1, Sep., 1998.

H. N. Oguz and A. Prosperetti, The Natural Frequency of Oscillation of Gas Bubbles in Tubes, J. Acoust, Soc. Am., 1998 Acoustical Society of America, vol. 103, No. 6, Jun. 1998.

M. C. Sharatchandra, M. Sen, and M. Gad–el–Hak, Thermal Aspects of a Novel Viscous Pump, Journal of Heat Transfer, vol. 120, pp. 99–107, 1998.

Thomas K. Jun and Chang–Jin Kim Microscale Pumping with Traversing Bubbles in Microchannels, in the Proceedings of the Solid State Sensor and Actuator Workshop, Hilton Head, South Carolina, Jun. 1996, pp. 144–147.

Koichi Ozaki, Pumping Mechanism Using Periodic Phase Changes of a Fluid, in the Proceedings of the 1995 IEEE Conference on Microelectromechanical Systems, pp. 31–36.

Liwei Lin, A. P. Pisano, and V. P. Carey, Thermal Bubble Formation on Polysilicon Micro Resistors, Journal of Heat Transfer, vol. 120, pp. 735–742, Aug. 1998.

* cited by examiner

*Primary Examiner*—Cheryl J. Tyler
(74) *Attorney, Agent, or Firm*—McGuireWoods, LLP

(57) ABSTRACT

A micro-pump pumps either electrically conductive or non-conductive liquids through channels of the micro-pump and/or micro-devices. A conductive or non-conductive liquid, depending on the specific application of the present invention, is disposed within a liquid chamber and/or channel of the micro-pump. An energy source is then applied to the micro-pump of the present invention in order to form one or more vapor bubbles within the chamber and/or channel. Thereafter the vapor bubble(s) is collapsed, and the process of forming and collapsing the vapor bubble may thereafter be repeated. By the formation and collapsing cycle of the vapor bubble, a pumping action of the liquid is effectuated thereby transporting the liquid within the micro-pump of the present invention and/or micro-devices.

27 Claims, 5 Drawing Sheets

BUBBLE BASED MICROPUMP

This application claims benefit to U.S. provisional application 60/117627 filed Jan. 28, 1999.

The present invention was made using grant money from the Air Force Office of Scientific Research having grant number F49620-96-1-0386. The government may have certain rights in this invention.

DESCRIPTION

Background of the Invention

1. Field of the Invention

The present invention generally relates to a liquid pump and, more particularly, to a liquid pump which forms vapor bubbles in order to transport either electrically conductive or non-conductive liquid through channels and/or micro-devices.

2. Background of the Invention

Micro-pumps have considerable applications, for example in existing and prospective micro-fluid-handling systems such as "laboratory-on-a-chip" devices increasingly used in biomedicine, pharmaceuticals, environmental monitoring, and other applications. Other applications, actual or under consideration, include, for example, miniature polymerase chain reactors, electronic cooling systems, micro-mixing apparatuses, etc. In all of these applications, micro-pumps increase the pressure of the fluid and/or cause the motion of liquid for the transport of chemicals, heat transfer, or other known purposes.

Many micro-pumps use mechanical moving parts in order to provide pumping action. By way of example known actuation mechanisms include (i) piezoelectric micro-pumps and (ii) thermo-pneumatic micro-pumps.

As a general background, a piezoelectric micro-pump uses piezoelectric disks to drive valves (e.g. check valves) that, opening and closing at opportune times during the cycle, promote the motion of the fluid in one direction only. In a thermo-pneumatic micro-pump the same action is achieved by means of a small amount of gas (or a gas/liquid mixture) contained in a cavity separated by a suitable membrane from the liquid. By alternatively heating and cooling the gas (or the mixture), the gas (or the mixture) pressure rises and falls and actuates the membrane. This motion of the membrane then displaces the liquid within the cavity of the thermo-pneumatically driven micro-pump, much as in the piezoelectric system previously described.

Many of these micro-pumps have known drawbacks which contribute to their inefficiency. For example, a drawback of the piezoelectric micro-pump is the size of the piezoelectric disks (about 10 mm) that prevents a true miniaturization of the device. In addition, these systems require high voltages (with attendant high costs), and only provide small displacements, of the order of a few microns. Due to the relative slowness of heat transport in the existing devices, thermo-pneumatically driven micro-pumps suffer from a low frequency of operation which severely limits the liquid flow rate achievable with these systems. Moreover, since all the above devices (and pumps in general) contain moving mechanical parts, they are subject to mechanical failure due to imperfection of construction or materials, stress, fatigue, and other mechanical factors.

Of course other micro-pumps also exist that are based on non-mechanical moving parts, for example (i) ultrasonically driven micro-pumps, (ii) evaporation/condensation systems, and (iii) valveless micro-pumps. By way of example, ultrasonically driven micro-pumps induce fluid motion by the peristaltic action of traveling flexural waves. Similar to the piezoelectric pumps described above, these systems cannot be made very small due to the intrinsic size of the ultrasonic source and vibrating membranes. Evaporation/condensation systems do provide transport of liquid by causing evaporation in one place and condensation in another one (e.g., micro-heat pipes) but, again, their smallest size is limited to the centimeter scale and requires that the entire amount of liquid achieve a high temperature, which may cause undesirable degradation and would not be applicable to the transport, e.g., of liquid with dissolved proteins or other biological material. Some arrangements have been proposed in which ordinary valves are not required (hence the denomination "valveless"), but again one needs an actuation mechanism—piezoelectric or thermo-pneumatic—with all the above described drawbacks. What is thus needed is a micro-pump that does not rely on any mechanical moving parts in order to provide proper transport of fluid. What is further needed is a micro-pump that offers greater simplicity of construction and operation and the ability to work "on demand" with great flexibility of operation in terms of pumping rates and faster flow rates than those presently known.

SUMMARY OF THE INVENTION

It is therefore an object of the present invention to provide a micro-pump which forms vapor bubbles in order to transport either electrically conductive or non-conductive liquid through channels of the micro-pump and/or micro-devices.

It is a further object of the present invention to provide a micro-pump capable of pumping liquid in very small channels by exploiting bubbles properties.

It is still a further object of the present invention to provide a micro-pump that does not utilize any mechanical moving parts.

It is also another object of the present invention to provide a micro-pump that offers simplicity of construction and operation.

The present invention is directed to a micro-pump for pumping either electrically conductive or non-conductive liquids through channels of the micro-pump and/or micro-devices. In order to accomplish the above objectives, a conductive or non-conductive liquid, depending on the specific application of the present invention, is disposed within a liquid chamber and/or channel of the micro-pump. An energy source is then applied to the micro-pump of the present invention in order to form one or more vapor bubbles within the chamber and/or channel. Thereafter the vapor bubble(s) is collapsed, and the process of forming and collapsing the vapor bubble may thereafter be repeated. By the formation and collapsing cycle of the vapor bubble, a pumping action of the liquid is effectuated thereby transporting the liquid within the micro-pump of the present invention and/or micro-devices.

In use, the underlying concepts of the present invention may be utilized in several known embodiments, all of which form and collapse vapor bubbles in order to transport liquids. For example, in one embodiment, an electrically conductive liquid is disposed within opposing electrically conductive channels of different diameters. Electrical current in then provided to the conductive channels (thereby completing a conductive path between the conductive channels and the conductive liquid) in order to form the vapor bubble in a conical section disposed between the opposing conductive channels. In other embodiments, a heat source is applied to the liquid disposed within a channel in order to create the vapor bubbles therein. In some of these other embodiments, liquid disposed within a conical section of the channel is contemplated for use by the present invention, such that the heater is placed in the conical section (partially or fully surrounding it) and the vapor bubble is formed therein. It is important to note that the pumping action is due to the asymmetrical properties of the micro-pump of the present invention, whether it be the asymmetrical properties presented by the conical section or the asymmetrical properties created by the placement of the energy source along the chamber and/or channel.

A method of using the micro-pump of the present invention is also contemplated for use herein.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENTS OF THE INVENTION

The present invention is directed to a micro-pump for pumping electrically non-conductive or conductive liquids through a channel, and more specifically to a micro-pump that transports the non-conductive or conductive liquids through the channel without any moving mechanical parts. The micro-pump of the present invention further offers simplicity of construction and operation and the ability to have flexibility of operation in terms of pumping and flow rates.

In order to accomplish the objectives of the present invention, the micro- pump of all embodiments of the present invention form vapor bubbles within a channel containing a liquid, such as, for example, water with dissolved NaCl or other conductive or non-conductive liquid. The channel may be any known shape, such as, for example, rectangular, triangular, circular and the like. The formation of the vapor bubble in the channel causes a motion of the liquid which is capable of overcoming a pressure difference equivalent to the hydrostatic head (of the liquid) of several centimeters. In the embodiments of the present invention, the formation of the vapor bubble is provided by either an electric current or a heater, depending on the liquid within the micro-pump or other variables.

In order to better understand the micro-pump of the present invention and the specific application thereof, it is important to note that vapor bubbles in liquids possess mechanical properties that are extremely useful and beneficial to the application of micro-devices and more specifically to the application of the micro-pump of the present invention with micro-devices. In particular, vapor bubbles have intrinsic time scales which are very short thus making them suitable for operation at tens or perhaps hundreds of kHz. Moreover, the energy density of vapor bubbles is on the order of tens of MW/m3, which offers advantages for effective pumping actuation. It is further understood that other important features of the present invention include (i) direct and efficient electrical-to-mechanical power conversion, (ii) absence of mechanical moving parts and (iii) the absence of solid-solid friction.

Electrical Conducting Micro-Pump

The micro-pump of the present invention is suitable for pumping liquids in channels, preferably with diameters on the order of several microns to approximately five millimeters. However, it is well understood that the present invention is not limited to the above range of diameters, and that other diameters may equally be used with the present invention. Thus, the specific numbers and dimensions specified herein (for all embodiments) are not to be construed as limitations on the scope of the present invention unless otherwise noted herein, but are meant to be merely illustrative of one particular application of the present invention.

Figure 1:
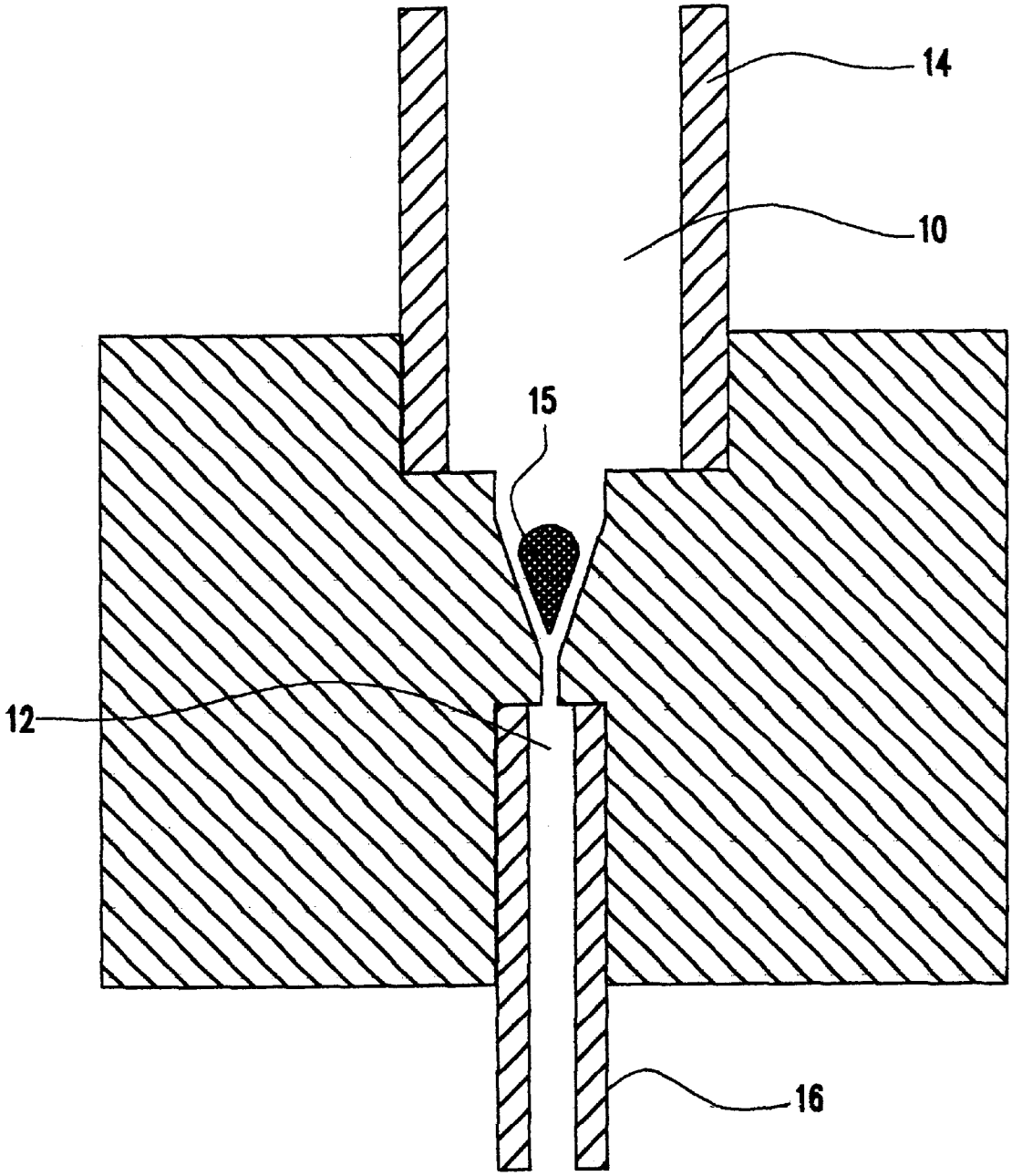
FIG. 1 shows a liquid pump for electrically conducting liquid of the present invention using tube electrodes.

Referring now to FIG. 1, a first embodiment of the present invention is shown. The embodiment of FIG. 1 is used for the formation of vapor bubbles with the use of a conductive liquid such as, for example, salt water, liquid metals and the like. The first embodiment shown in FIG. 1 includes a conical chamber 10 having a constricted throat 12. In the preferred implementation of the micro-pump of the present invention, the conical chamber 10 is preferably a non-conductive material, such as, plastic, Plexiglas and the like; but may equally be other materials depending on the specific application of the micro-pump of the present invention. Moreover, in the preferred embodiment, the conical chamber 10 provides an asymmetry within the micro-pump of the present invention and more specifically, in embodiments, between two suitably-sized conductive electrode channels 14 and 16 as described more fully below.

Still referring to FIG. 1, two suitably-sized conductive electrode channels 14 and 16 are disposed at opposing ends of the conical chamber 10. In the preferred embodiment, the conductive electrode channel 14 is larger than the conductive electrode channel 16, and even more preferably, the diameter of the conductive electrode channel 14 is approximately 1.5 to twice the diameter of the conductive electrode channel 16. It is important to note that each of these conductive electrode channels 14 and 16 are capable of conducting electricity, and that the conductive electrode channels 14 and 16 provide a liquid tight connection at the ends of the chamber 10. It is further important to note that the conductive electrode channels 14 and 16 are not limited to any specific conductive material and may include any conductive material that is appropriate for the specific application of the micro-pump of the present invention.

In one embodiment of the micro-pump of the present invention, the chamber 10 may be formed in a Plexiglas plate by drilling, laser ablation and the like, and the conductive electrode channels 14 and 16 may be needles communicating with the chamber 10 and embedded within the Plexiglas plate. However, and as discussed above, it is well understood that the chamber 10 and the conductive electrode channels 14 and 16 may equally be other types of materials. Moreover, the exact dimensions of the present invention are not critical to the understanding of the present invention, and the only limitation on the dimensions of the present invention is that (i) the constricted throat 12 has a smaller diameter than the channel 16, (ii) the diameter of the conductive electrode channel 16 is smaller than the diameter of the conductive electrode channel 14, (iii) the conical chamber 10 provides an asymmetry within the micro-pump and (iv) the diameters of the conductive electrode channels 14 and 16 are preferably in the range between approximately several microns to five millimeters.

To begin pumping, current is passed through the respective conductive electrode channels 14 and 16, and a conductive liquid filling the channels 14 and 16. The current is preferably placed upstream and downstream of the constricted throat 12, and provides current pulses to the conductive electrode channels 14 and 16. The conductive liquid in combination with the conductive electrode channels 14 and 16 completes an electric circuit such that the electric current passing through the liquid is "squeezed" in the constricted throat 12. This "squeezing" action results in an intense localized heating which causes the formation and rapid growth of a vapor bubble 15 (i.e., local boiling). In the preferred embodiments, the vapor bubble 15 grows in a direction of the wider channel 14 due to effects of surface tension of the asymmetry presented by the conical chamber 10.

As discussed, the action of the surface tension of the conductive liquid causes the vapor bubble 15 to grow preferentially in the expanding portion of the conical chamber 10 (e.g., above the constricted throat 12 and in the direction of the wider channel 14). As the vapor bubble 15 expands and forms, it exerts force on the column of liquid in the wider channel 14. This application of force on the column of liquid thus pushes the liquid along the conductive electrode channel 14. That is, the formation and expansion of the vapor bubble 15 within the conical chamber 10 displaces a certain volume of the conductive liquid preferably within wider channel 14. When the electrical current is stopped, the bubble 15 collapses and the conical chamber 10 refills with liquid. It is important to the understanding of the present invention that during bubble growth the liquid is passed preferably in the direction of the wider channel 14, while the liquid enters into the conical chamber 10 approximately in equal amounts from both channels 14 and 16 when the bubble collapses. Thus, by applying and stopping the current, an overall net displacement of liquid is effectively provided.

It is well understood that more than one pulse frequency and current may be applied to the micro-pump of the present invention. However, as can be readily appreciated by one of ordinary skill in the art, the pulse frequency and the current is dependent on the diameter of the conductive electrode channels 14 and 16 as well as the specific materials and conductive liquids used with the present invention. For example, larger diameter conductive electrode channels 14 and 16 would result in the need for a larger current and/or longer pulses so as to provide the beneficial effects of the present invention (i.e., to adequately grow the bubble 15 in order to provide an adequate pumping force of the liquid).

Non-Electrical Conducting Micro-Pump

Similar to the electrical conducting micro-pump described above, the non-electrical conducting micro-pump of the present invention is suitable for pumping liquids in various sized channels, and offers simplicity of construction and operation and the ability to have great flexibility of operation in terms of pumping and flow rates. The non-electrical conducting micro-pump is especially adapted for use with non-conductive liquid; however, it is well understood that conductive liquids may equally be used with this embodiment.

Figure 2:
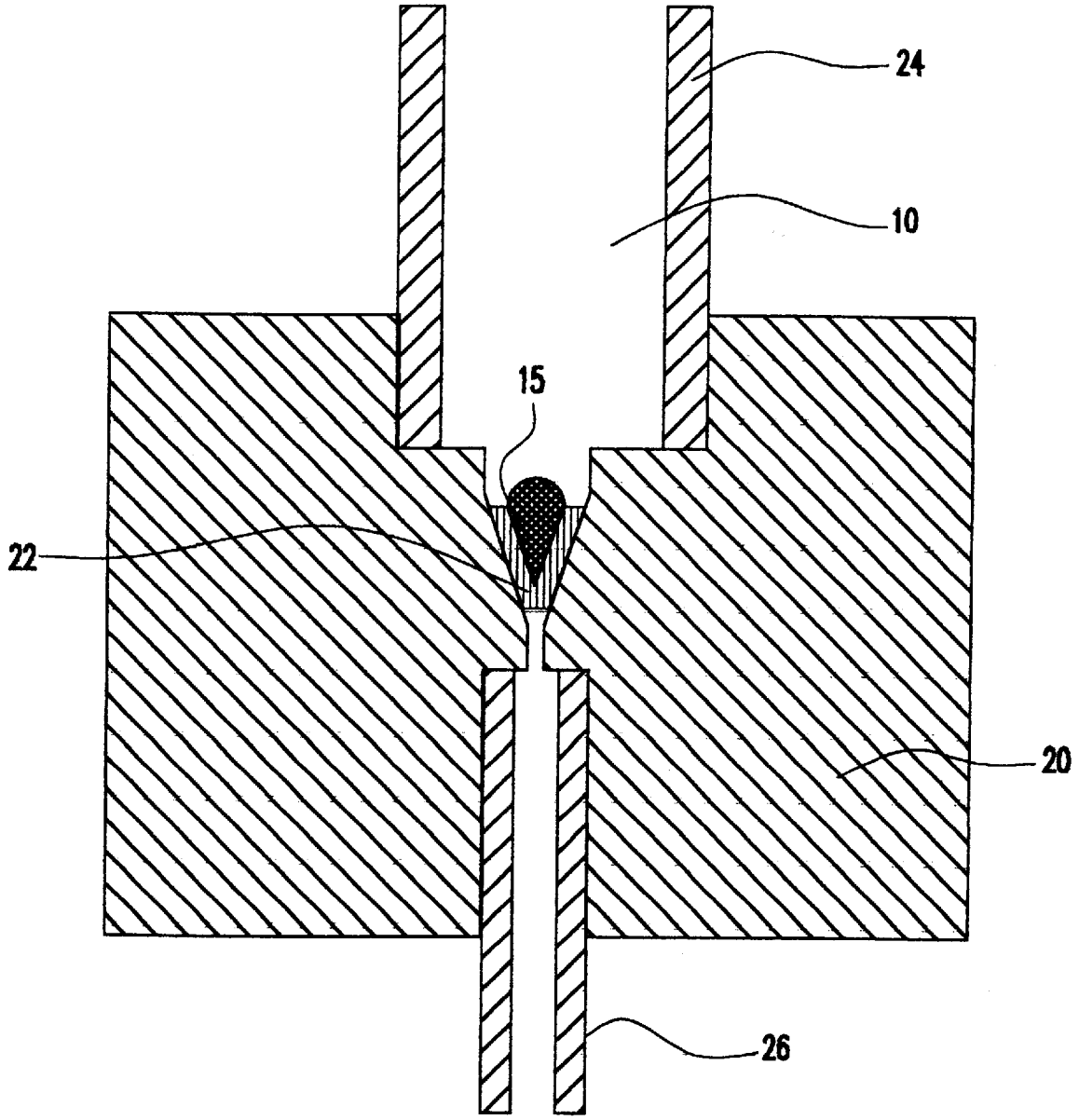
FIG. 2 shows a liquid pump for electrically conducting or non-conducting liquid of the present invention.

Now referring to FIG. 2, the non-electrical conducting micro-pump of the present invention is shown which is especially adapted for use with non- conductive liquids. Specifically, FIG. 2 shows a Plexiglas or other non-conductive substrate 20. A non-conductive conical chamber 10 is provided within the non-conductive substrate 20 by drilling, laser ablation or any other well known process. Similar to the embodiment of FIG. 1, the conical chamber 10 may equally be plastic, Plexiglas or any other material depending on the specific application thereof.

Moreover, in the preferred embodiment, the conical chamber 10 provides an asymmetry of the micro-pump of the present invention as described above.

Two suitably-sized non-conductive channels 24 and 26 are disposed at opposing ends of the conical chamber 10. Note that conductive channels 24 and 26 may also be used with the embodiment of FIG. 2. In the preferred embodiment, the non-conductive channel 24 is larger than the non-conductive channel 26, and even more preferably, the diameter of the non-conductive channel 24 is approximately 1.5 to twice the diameter of the non-conductive channel 26. A heater 22 is disposed at the conical chamber 10, and provides heat in order to form a bubble at the conical chamber 10. In the embodiments of the present invention, the heater 22 may partially or totally surround the conical chamber 10.

To begin pumping, the heater 22 is powered which provides localized heat at the conical chamber 10. The heating in the localized area of the conical chamber 10 causes the formation and rapid growth of a vapor bubble 15. As in the embodiment of FIG. 1, the vapor bubble 15 grows in a direction of the wider channel 24 due to the effects of surface tension presented by the asymmetry of the conical chamber 10. As the vapor bubble 15 expands and forms, it exerts force on the column of liquid in the wider channel 24. This application of force on the column of liquid thus pushes the liquid along the conductive channel 24. That is, the formation and expansion of the vapor bubble 15 within the conical chamber 10 displaces a certain volume of the non-conductive liquid preferably within wider channel 24. When the electrical current is stopped, the bubble 15 collapses and the conical chamber 10 refills with liquid. Again, by applying and stopping the localized heating, an overall net displacement of liquid is effectively provided, similar to the embodiment of FIG. 1.

It is well understood that different heat levels may be applied to the micro-pump of the present invention. However, as can be readily appreciated by one of ordinary skill in the art, the heat is dependent on the diameter of the non-conductive channels 24 and 26 as well as the specific materials and non-conductive liquids used with the present invention. For example, larger diameter non-conductive channels 24 and 26 would result in the need for more heat to provide the beneficial effects of the present invention (i.e., to adequately grow the bubble 15 in order to provide adequate force to pump the liquid).

Multi-Heater Liquid Micro-pump

Figure 3A:
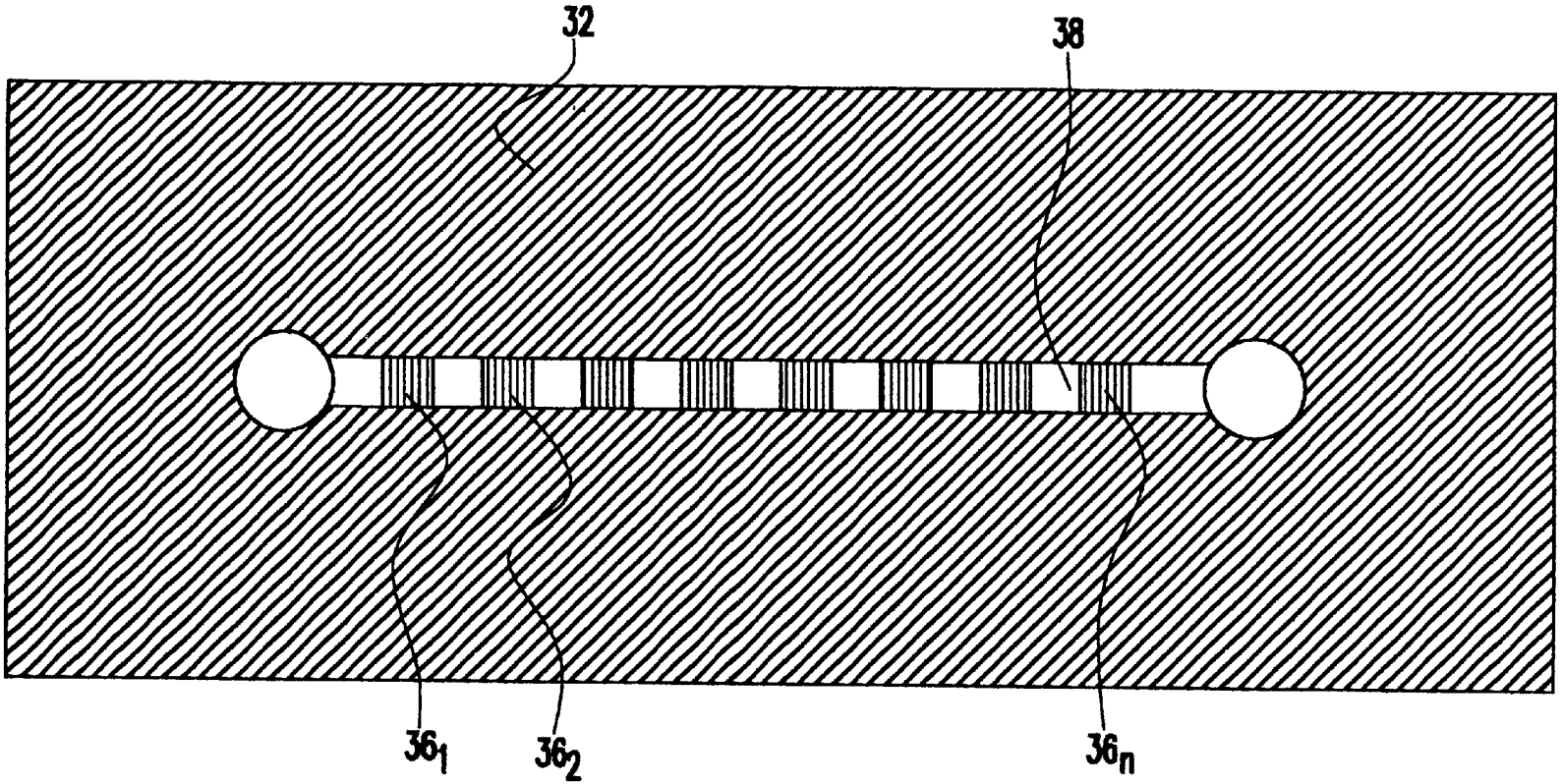
FIG. 3*a* shows a top view of the multi-heater liquid micro-pump of the present invention.
Figure 3B:
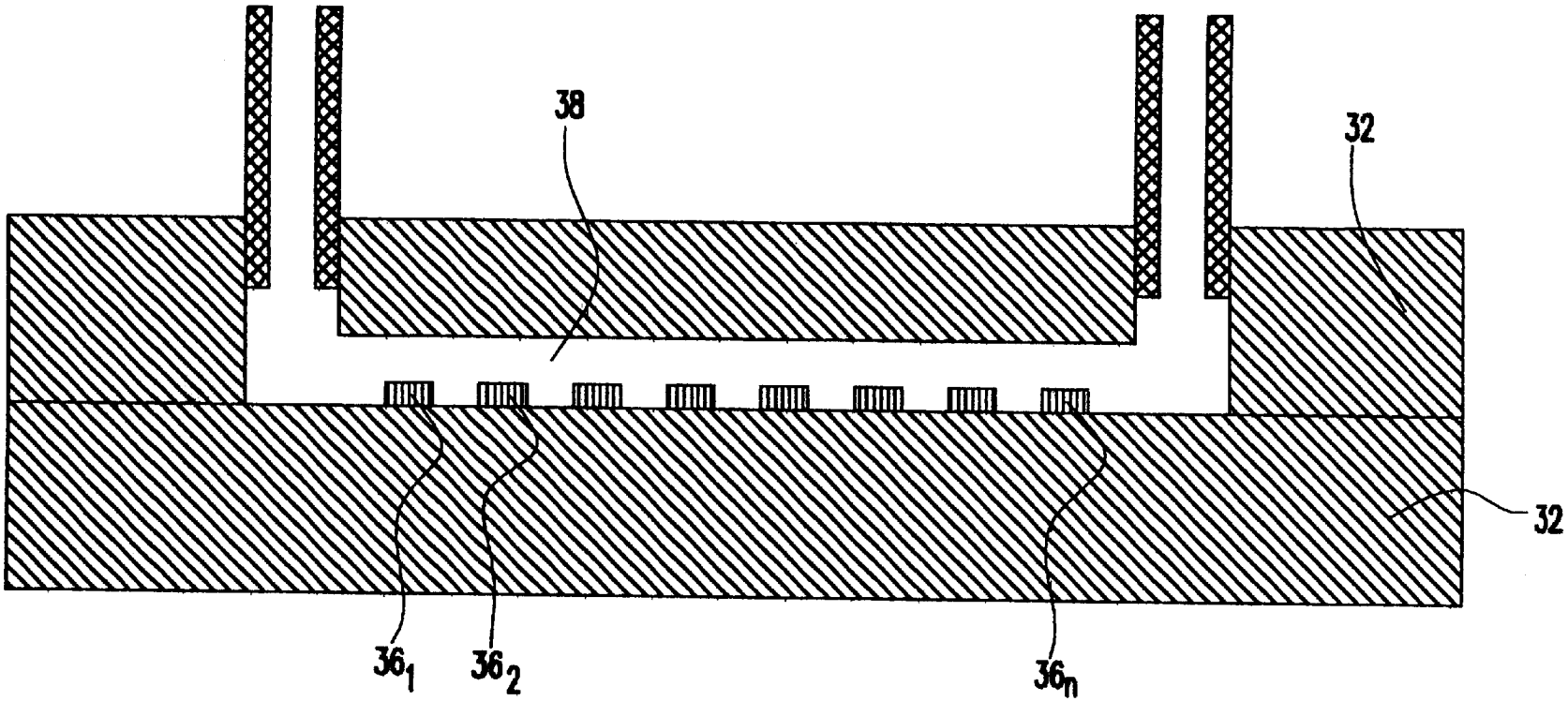
FIG. 3*b* shows a side view of the multi-heater liquid micro-pump of the present invention.

FIG. 3*a* is a top view of the multi-heater liquid micro-pump and FIG. 3*b* is a side view of the multi-heater liquid micro-pump of the present invention. Similar to the embodiment of FIG. 2, energy is supplied to the heater in a sequence such that liquid is pushed along the channel in a pumping action. The embodiment of FIGS. 3*a* and 3*b* is especially adapted for use with electrically non-conductive liquids; however, it is well understood that conductive liquids may equally well be used with the embodiment of FIGS. 3*a* and 3*b* provided non-electric heaters are used or, with electric heaters, provided they are covered by a thin film of electrically insulating material.

The embodiment of FIGS. 3*a* and 3*b* include a channel 38 of arbitrary cross section in an electrically non-conducting or conducting solid material 32 such as Plexiglas, plastic, or other well known materials. A series of electric heaters $\mathbf{36}_1$, $\mathbf{36}_2$, $\mathbf{36}_n$, are embedded along the base of the channel 38, as shown in FIG. 3*b*, or in any other convenient location such as the sides or the top. It is well understood that the present embodiment is not limited to any specific number of heaters, but should preferably include at least three heaters.

In use, each of the heaters $\mathbf{36}_1$, $\mathbf{36}_2$, $\mathbf{36}_n$ is briefly powered in succession (electrically or otherwise), such that vapor bubbles form at each heater $\mathbf{36}_n$, $\mathbf{36}_2$, $\mathbf{36}_n$. Enough power is applied to each heater to generate a bubble, which condenses and collapses when the power is removed. The timing is such that, when a new bubble grows, for example, on heater $\mathbf{36}_2$, the previous bubble associated with heater $\mathbf{36}_n$, is just starting to collapse. Thus, as the bubble grows on heater $\mathbf{36}_2$, the bubble on $\mathbf{36}_n$, effectively blocks the channel and prevents the liquid from being pushed backward.

With this arrangement, in order to accommodate the growth of the bubble on heater $\mathbf{36}_2$, liquid can only move forward in the direction of heater $\mathbf{36}_n$, and so forth. In this way, a column of liquid is moved along the channel by the successive growth and collapse of the bubbles. After the bubble on the last heater $\mathbf{36}_n$ has collapsed, the cycle repeats, starting again from $\mathbf{36}_n$, and so on.

As a variant of the basic design of FIGS. 3*a* and 3*b*, in order to facilitate the blocking of the channel by a bubble thus preventing the liquid from flowing backward, the channel can be enlarged around each heater so that the bubble can grow larger than the channel cross section and cannot be pushed along the channel by the bubble growing next. Since the blocking action is an effect of the surface tension of the liquid, the channel diameter should not preferably exceed a few millimeters. It is well understood that the precise timing of the bubble generation, the duration and amount of the heating, and other similar operational characteristics will depend on the specific application and conditions of each utilization of the micro-pump.

Two Reservoir Liquid Micro-Pump

Figure 4:
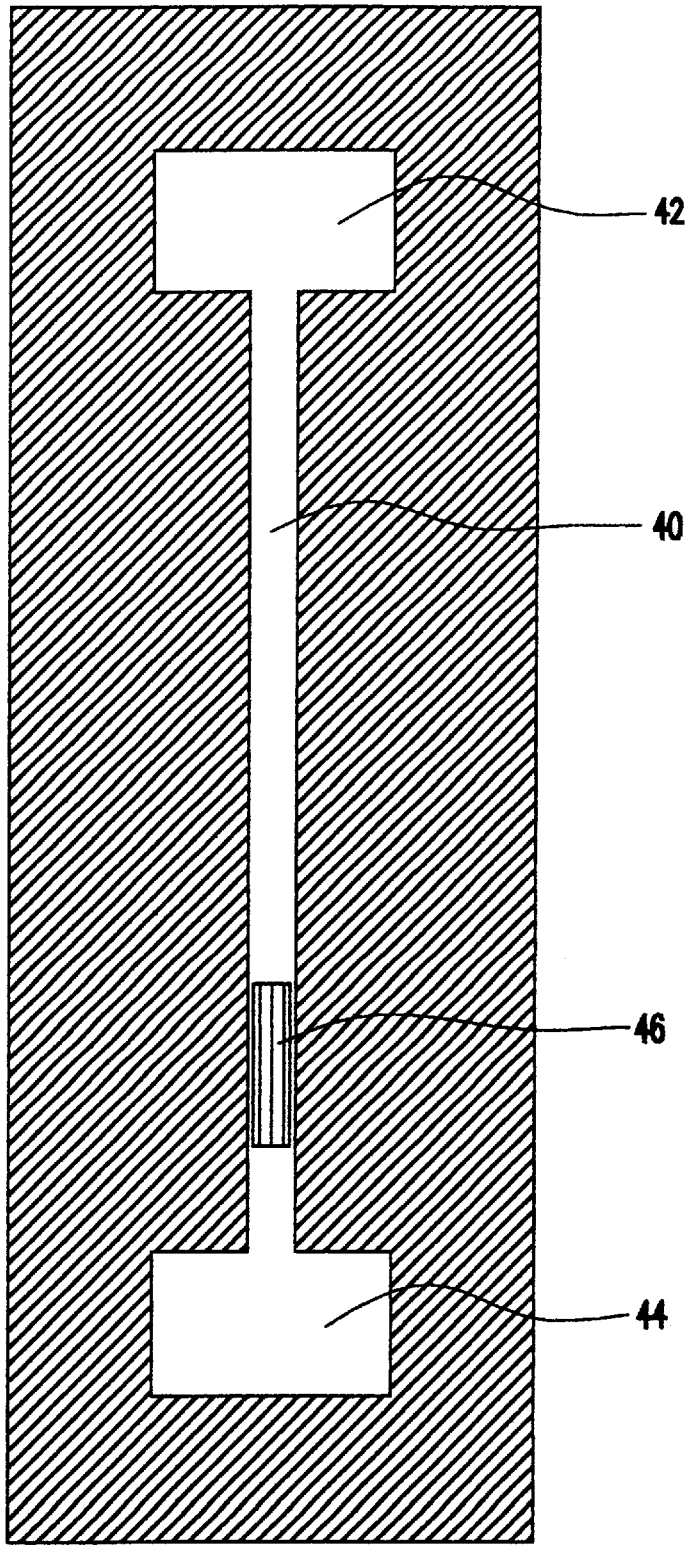
FIG. 4 shows a two reservoir liquid pump of the present invention.

FIG. 4 shows a two reservoir liquid pump of the present invention. Similar to the embodiments of FIGS. 1–3, energy is supplied to the system in order to form vapor bubbles which then push the liquid along a channel in order to produce a pumping action. It is further noted, as with the embodiments of FIGS. 1–3, that the micro-pump of the present embodiment can be made of many materials that are suitable for use with either a conductive or non-conductive liquid.

Referring now to FIG. 4, a channel 40 is disposed between two reservoirs, a first reservoir 42 and a second reservoir 44. A heater 46 is provided at any position along the channel 40, except the middle thereof The asymmetry of the system of the embodiment of FIG. 4 arises due to the fact that the heater 46 is not provided at the mid point of the center channel 40. In the preferred embodiment, the heater 46 is placed at a distance approximately between the range of 20%–40% of the channel 40 length from one of the reservoirs 42, 44.

Similar to the embodiments of FIGS. 2 and 3, the heater 46 provides a localized heat which forms a vapor bubble. The vapor bubble collapses when the heating is stopped and the localized heat dissipates. Moreover, similar to the embodiments of FIGS. 2 and 3, the reservoirs 42 and 44 as well as the channel 40 may be provided in a substrate, preferably of non-conductive material. However, conductive material is further contemplated for use with the present embodiment of FIG. 4.

Application of Use

The micro-pump of the present invention may be used in many applications, ranging from micro-electronic devices to printers to medical applications. By way of illustrative examples, a medical application and a printer will be discussed herein. However, it is well understood that the following examples are merely illustrative of the application of the micro-pump of the present invention and is not limited by such illustrative examples.

By way of example, the micro-pump of the present invention, and specifically the micro-pump of FIG. 3, may be used as a laboratory chip in order to test a small discrete volume of liquid, such as, for example, blood, urine or other bodily fluids. In use, the micro-pump of the present invention would transport the appropriate bodily fluid along channels as described above. At predetermined positions along the channels would be a particular reagent, such as an antibody. If reactive antigens were present in the biological fluid, then such reactive antigen would bind to the antibody thus resulting in a detectable antigen/antibody complex. This complex can then be flushed with other reagents in order to permit detection. This same procedure can be accomplished using the same bodily fluid on the same laboratory chip with different antibodies placed at different channel sites in order to thus detect other antigen/antibody complexes. Thus, by using the micro-pump of the present invention, a laboratory chip can be manufactured and used in an economically viable manner. This same procedure would also help to eliminate waste, and would further eliminate the need to add and/or remove various solutions by mechanical means.

By way of another example, the micro-pump of the present invention may also be used for sequential organic syntheses, such as, for example, micro- scale peptide syntheses. In general, a first amino acid of the peptide chain may be immobilized in a channel of the micro-pump. A series of coupling reagents may then be "pumped" within the channels of the micro-pump of the present invention in order to react with the immobilized first amino acid. As is known to one of ordinary skill in the art, this bonding between the immobilized first amino acid and the coupling reagents forms a peptide sequence.

It is also contemplated that the micro-pump of the present invention may be used in printers, such as ink jet printers. In the application of ink jet printers, ink is placed within the channel of the ink-jet printer and the vapor bubble, formed via localized heat, exerts force on the column of ink in the channel. This application of force on the column of ink pushes the ink along the channel and through a nozzle for discharging onto paper.

While the invention has been described in terms of its preferred embodiments, those skilled in the art will recognize that the invention can be practiced with modification within the spirit and scope of the appended claims. Accordingly, the present invention should not be limited to the embodiments as described above, but should further include all modifications and equivalents thereof within the spirit and scope of the description provided herein.

Having thus described our invention, what we claim as new and desire to secure by Letters Patent is as follows:

1. A micro-pump for pumping a liquid between reservoirs, comprising:

a channel connected between the two reservoirs, the liquid being disposed within the channel, wherein the channel comprises:

a first tube having a first diameter;

a second tube having a second diameter, the first diameter being larger than the second diameter;

a conical shaped chamber disposed between the first and the second tube; and means for forming one or more vapor bubbles in the channel, wherein the forming means or the channel provide an asymmetry for a pumping action of the liquid.

2. The micro-pump of claim 1, wherein the forming means is a heater disposed at the conical shaped chamber, the heater providing a localized heat at the conical shaped chamber to the liquid therein.

3. The micro-pump of claim 2, wherein the first and second tubes are made of non-conductive material.

4. The micro-pump of claim 1, further comprising a throat disposed between the conical shaped chamber and the second tube, the throat has a smaller diameter than the second diameter of the second tube.

5. The micro-pump of claim 4, wherein:

the first and second tubes are made of electrically conductive material and the liquid disposed within the first and second tubes and the chamber is conductive liquid;

the conical shaped chamber is made of a non-conductive material; and the forming means provides current passing between the first and second electrically conductive tubes, the current provides a localized heating within the throat thereby forming the vapor bubble and pushing the liquid in the direction of the first tube.

6. The micro-pump of claim 2, wherein the first diameter of the first tube is approximately 1.5 to 2 times the second diameter of the second tube.

7. The micro-pump of claim 1, wherein the first and second diameters are several microns to approximately five millimeters.

8. A micro-pump for pumping a liquid between two reservoirs, comprising:

a channel connected between a first reservoir and a second reservoir the liquid being disposed within the channel;

means for forming one or more vapor bubbles in the channel wherein the forming means or the channel provide an asymmetry for a pumping action of the liquid, wherein the forming means is a heater disposed at an asymmetric position along the channel and provides localized heat to the liquid at the asymmetric position and the heater is comprised of two heater units positioned proximate to a first end and a second of the channel in order to provide a bi-directional pump in which flow direction is dependent on which of the two heater units are energized.

9. The micro-pump of claim 8, wherein the heater is placed at a distance approximately in the range of 20%–40% of the channel length from the first or second reservoirs.

10. The micro-pump of claim 1, wherein the forming means is a plurality of heaters provided along the channel, the plurality of heaters provides localized heating in successive order along the channel in order to form in successive order a plurality of vapor bubbles in the channel.

11. The micro-pump of claim 1, wherein the forming means includes an axis aligned in the direction of the channel.

12. A micro-pump for pumping liquid, comprising:

a first channel having a first diameter;

a second channel having a first diameter, the second diameter being larger than the second diameter;

a chamber disposed between the first and second channels and having an asymmetric portion; and an energy source disposed at the asymmetric portion, the energy source heating the liquid disposed within the micro-pump thereby forming a vapor bubble.

13. The micro-pump of claim 12, wherein the first and second channels are non-conductive and the energy source is a heater.

14. The micro-pump of claim 13, wherein the asymmetric portion is a conical section disposed proximate to the first channel.

15. The micro-pump of claim 12, wherein the first and second channels are electrically conductive and the energy source provides an electric current to the first and second channels.

16. The micro-pump of claim 15, further comprising:

a throat disposed between the asymmetric portion and the second channel, wherein the liquid is a conductive liquid, the electric current between the first and second electrical conductive channels and the conductive liquid form an electric circuit, and the electric current produces heat within the throat thereby forming the vapor bubble within the asymmetric portion of the chamber.

17. The micro-pump of claim 15, wherein the first diameter of the first tube is approximately 1.5 to 2 times the second diameter of the second tube.

18. A micro-pump for pumping liquid comprising:

a channel positioned between a first reservoir and a second reservoir and adapted for having liquid being disposed therethrough; and at least one heater disposed proximate to the channel, the at least one heater providing localized heat to the liquid in the channel at an asymmetric position along the channel whereby the localized heat forms at least one vapor bubble, wherein the at least one heater is two heaters positioned proximate to a first end and a second and opposing end, respectively, of the channel in order to provide a bi-directional pump in which flow direction is dependent on which of the two heaters are energized.

19. The micro-pump of claim 18, further comprising:

a first reservoir disposed at a first end of the channel; and a second reservoir disposed at a second and opposing end of the channel, wherein the at least one heater is at a position at a distance approximately between the range of 20%–40% of the channel length from the first or second reservoir.

20. The micro-pump of claim 18, wherein the at least one heater is at least three heaters provided along the channel and the at least three heaters provide localized heating in successive order along the channel in order to form in successive order a plurality of vapor bubbles in the channel.

21. A method of pumping liquid in a micro-pump in absence of a valve, the micro-pump including a channel for transporting the liquid between two reservoirs, the method comprising the steps of:

providing localized heat to the liquid;

forming a vapor bubble from the liquid at a location of the localized heat; and collapsing the vapor bubble, wherein the liquid is transported between the two reservoirs by the formation and collapsing of the vapor bubble wherein the providing localized heat is provided by a heater and the heater is heating the liquid within a conical section of the channel in order to form the vapor bubble.

22. The method of claim 21, wherein the vapor bubble pushes the liquid in the channel.

23. The method of claim 21, wherein a net displacement of liquid is provided by the forming and the collapsing of the vapor bubble.

24. The method of claim 21, wherein the localized heat is provided by at least three heaters along the channel, each of the at least three heaters are briefly powered in succession such that vapor bubbles form at each of the at least three heaters, and a timing of the heating of each of the at least three heaters is such that when a vapor bubble is beginning to collapse, a new vapor bubble grows at a next of the each of the at least three heaters.

25. The method of claim 24, wherein the new vapor bubble blocks the channel and prevents the liquid from being pushed backward in the channel.

26. A method of pumping liquid in a micro-pump, the micro-pump including a channel for transporting the liquid therein, the method comprising the steps of:

providing localized heat to the liquid by electric current;

forming a vapor bubble from the liquid at a location of the localized heat;

collapsing the vapor bubble; and squeezing the electric current through a throat of the channel in order to provide the localized heat, wherein the electric current is provided at a conical section of the channel;

the conical section of the channel is disposed between the throat and a first electrically conductive portion of the channel and the throat is disposed between a second electrically conductive portion of the channel and the conical portion, a diameter of the first electrically conductive portion being wider than a diameter of the second electrically conductive portion.

27. The method of claim 26, wherein during bubble formation the liquid is passed in the direction of the first electrically conductive portion while the liquid enters into the conical section approximately in equal amounts from both the first and second electrically conductive portions when the bubble collapses.

* * * * *